United States Patent [19]

Virtanen

[11] 4,361,243

[45] Nov. 30, 1982

[54] CLOSING MEANS FOR A CONTAINER, TUBE OR THE LIKE

[75] Inventor: Risto Virtanen, Nurmijärvi, Finland

[73] Assignee: Perlos Oy, Nurmijärvi, Finland

[21] Appl. No.: 265,010

[22] Filed: May 19, 1981

[30] Foreign Application Priority Data

May 19, 1980 [FI] Finland ..... 801601

[51] Int. Cl.[3] ..... A61J 1/00; B65D 55/02

[52] U.S. Cl. ..... 215/206; 215/223; 220/260; 220/306

[58] Field of Search ..... 215/206, 223, 224, 317; 220/260, 306

[56] References Cited

U.S. PATENT DOCUMENTS 3,627,160 12/1971 Horvath ..... 215/206 X 4,095,718 6/1978 Kong ..... 215/223

*Primary Examiner*—George T. Hall

*Attorney, Agent, or Firm*—Eugene D. Farley

[57] ABSTRACT

There is illustrated in the drawings a discharge tube mounting a nozzle which is releasably closed at its outer, terminal end by a plug. A spaced distance above the base of the nozzle there is mounted a flange ring arranged to extend around the nozzle circumference, the flange ring being cut at one point. A rotatable and removable closing cap is fitted over the nozzle and includes at its lower rim an inwardly projecting nib configured to be captured between the flange ring and the upper rim of the tube to secure the cap to the tube, and to pass through the cut portion of the flange ring when aligned with it, to allow removal of the cap. The lower rim of the closing cap or the upper rim of the discharge tube mounts a separate background ring, preferably of a different color than the closing cap and discharge tube, and the ring is disposed behind a downwardly extending arrow-shaped indicator on the cap and behind an upwardly extending arrow-shaped indicator on the upper rim of the discharge tube. When the cap is rotated to align the opposing indicators, the nib is positioned in alignment with the cut portion of the flange and the cap may then be pulled upwardly and removed, thereby exposing the nozzle for use.

2 Claims, 2 Drawing Figures

CLOSING MEANS FOR A CONTAINER, TUBE OR THE LIKE

The present invention relates to a closing means intended for various types of containers or their nozzles, tubes or the like vessels, said closing means being openable only if turned into a predetermined position. For easier opening, this opening position is visually detectable by means of indicators fitted in the closing means and container, said indicators setting diametrally opposite to each other in the opening position.

Such profile-locked closing devices are generally used in containers and tubes which contain hazardous materials. For easier opening of a closing member it is, however, important that the indicators showing the opening position are clearly visible. This is generally resolved by making the indicators in different colors, by painting the indicators or by providing the indicators with clearly visible indicia. Such actions complicate and slow down production. It is preferable to manufacture the closing means by injection moulding in one piece. However, this leads to the problem that the indicator portion is not clearly distinguished from the remainder of a closing means.

The object of the invention is to provide a closing means which is simple to manufacture and adaptable to mechanical assembly and which is still capable of clearly indicating the opening position of the closing means.

The closing means of the invention is characterized by providing the lower rim of the closing means or the upper rim of the container with a separate background ring disposed at least partly behind the indicator of the closing means and that of the container.

This background ring is preferably made of a material of different color than the closing means and container.

Figure 1:
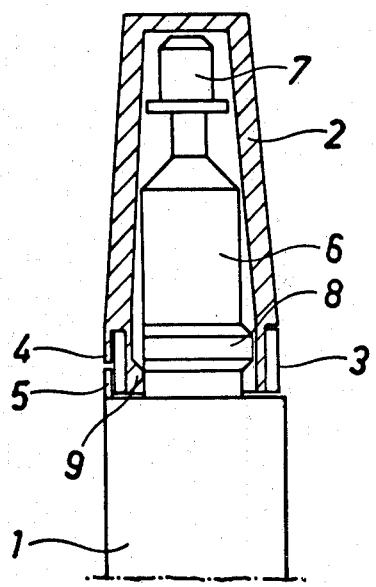
Figure 2:
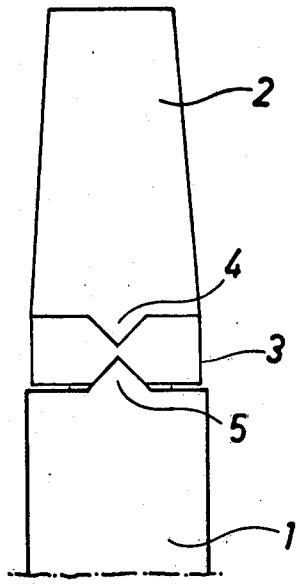

The invention is hereinbelow specified in more detail with reference made to the accompanying drawings, in which:

FIG. 1 is a sectional view of a closing means according to the invention fitted on a tube, and FIG. 2 is a similar view to FIG. 1 with the closing means in the opening position.

In the embodiment depicted in the figures, a closing means 2 is fitted over a tubular member 6 which provides the discharge duct for a tube 1 and is closed by a plug 7.

Adjacent to the base of the tubular member 6 is disposed a flange 8 extending around the tube but being cut at one point. The distance between flange 8 and tube 1 is sufficient to receive a nib 9 provided on the lower rim of closing means 2. Flange 8 and nib 9 of the closing means 2 form a profiled locking which can only be unlocked by turning the closing means 2 to that point on tube 1 where flange 8 is cut. At this point, the nib 9 can pass the otherwise blocking flange 8.

For indication of this position, the closing means 2 is, in accordance with the invention, provided with a separate background ring 3 in its lower rim. The lower rim of the closing means 2 is so designed that ring 3 is disposed behind a downwards directed arrow-shaped indicator 4 in the lower rim of the closing means 2. Ring 3 is sufficiently wide to also extend behind an upwards directed arrow-shaped indicator 5 in the upper rim of tube 1. Since, according to the invention, the material of ring 3 is of different color from that of the closing means 2 and tube 1, ring 3 thus provides a background for indicators 4 and 5 which are therefore clearly distinguishable and the aligned position thereof is clearly detected.

According to the present invention, the closing means 2 as well as the background ring 3 are readily manufactured by injection moulding.

The closing means 2 and background ring 3 can simply be assembled when assembling the tube. Naturally, the closing means must then be dimensioned so as to be capable of free rotation despite the background ring (3) secured to the container. Thus, the closing means manufacture does not involve any interfering extra actions but the process is quick and economical.

In the embodiment shown in the figures, the background ring 3 is mounted on the closing means 2. It should be appreciated that the invention can also be realized by mounting the background ring 3 on the upper rim section of the container, said ring 3 extending behind indicator 5 of the container 1 as well as behind indicator 4 of the closing means 2.

I claim:

1. Closing means (2) for a container (1), for a nozzle fixedly mounted thereon, for a tube or the like, said closing means being openable when turned into a predetermined position which is indicated by indicators (4, 5) provided on closing means (2) and on container (1) and settable diametrally opposite to each other, characterized in that the lower rim of closing means (2) or the upper rim of container (1) is provided with a separate background ring (3) extending at least partly behind indicator (4) of said closing means (2) and indicator (5) of said container (1).

2. Closing means as claimed in claim 1, characterized in that the color of the background ring (3) is different from those of the closing means (2) and container (1).

* * * * *